United States Patent [19]

Smart et al.

[11] Patent Number: 4,890,439

[45] Date of Patent: Jan. 2, 1990

[54] FLEXIBLE DISPOSABLE MATERIAL FOR FORMING A FOOD CONTAINER FOR MICROWAVE COOKING

[75] Inventors: Allen A. Smart, Pleasant Hill, Calif.;;;

[73] Assignee: James River Corporation, Richmond, Va.

[21] Appl. No.: 268,851

[22] Filed: Nov. 9, 1988

[51] Int. Cl.[4] ..... B65B 29/08; B65B 51/02; B65B 43/02; H05B 9/06

[52] U.S. Cl. ..... 53/410; 53/411; 53/440; 53/449; 53/455; 493/187; 493/264; 493/267; 493/189; 428/425.8; 428/458; 428/615; 219/10.55 E; 426/107; 426/124; 426/234

[58] Field of Search ..... 53/410, 411, 440, 449, 53/127, 128, 172, 562, 455, 456; 493/187, 264, 267, 189; 426/107, 113, 124, 234, 237; 219/10.55 E; 428/425.8, 457, 458, 548, 551, 615

[56] References Cited

U.S. PATENT DOCUMENTS

| | | | |
|---|---|---|---|
| 4,034,973 | 7/1977 | Hams . | |
| 4,144,438 | 3/1979 | Gelman et al. | 219/10.55 E |
| 4,196,331 | 4/1980 | Leveckis et al. | 426/107 X |
| 4,204,105 | 5/1980 | Leveckis et al. | 426/107 X |
| 4,230,924 | 10/1980 | Brastad et al. | 219/10.55 E |
| 4,267,420 | 5/1981 | Brastad . | |
| 4,268,738 | 5/1981 | Flautt, Jr. et al. | 219/10.55 E X |
| 4,641,005 | 2/1987 | Seiferth | 426/107 X |
| 4,735,513 | 4/1988 | Watkins et al. . | |
| 4,810,844 | 3/1989 | Anderson | 426/107 X |
| 4,825,025 | 4/1989 | Seiferth | 426/107 X |

*Primary Examiner*—Horace M. Culver
*Attorney, Agent, or Firm*—Sixbey, Friedman, Leedom & Ferguson

[57] ABSTRACT

A packaging material and a method of forming the packaging material into a flexible, disposable food container adapted to contain and maintain food in a fresh and sanitary condition, and to ship, display, heat and brown, and serve the food is disclosed. The method includes forming patches of microwave interactive material on a web of plastic and laminating the web of plastic to one side of a web of structural stock material to form a composite web; the microwave interactive material is sandwiched between the web of plastic and the web of structural stock material. Sealant is applied to portions of the plastic layer in registry with the patches of microwave interactive material to seal ends of the composite web. Printed graphics are applied to portions of the structural stock material layer in registry with the patches of microwave interactive material and the sealant. The formed container is sufficiently flexible to contain food having curved and irregular surfaces and to maximize contact of the food with the portion of the container housing the microwave interactive material. The container is sealed so that portions of the composite web extend as fins beyond the sealed ends of the food-containing portion of the container. The container also is capable of receiving food before the food is frozen to prevent portions or parts of the food from falling out of their proper place in the food packaging process.

40 Claims, 3 Drawing Sheets

FLEXIBLE DISPOSABLE MATERIAL FOR FORMING A FOOD CONTAINER FOR MICROWAVE COOKING

TECHNICAL FIELD

The present invention relates to flexible packaging for food containers for use in shipping, displaying, cooking, and serving food. More particularly, the present invention relates to food containers for microwave cooking in which the exterior of the food may be browned. This invention is an improvement over U.S. Pat. No. 4,641,005 to Seiferth, commonly assigned to James River Corporation.

BACKGROUND OF THE INVENTION

Heating and cooking food with microwave energy in a microwave oven is quite commonplace. However, although the molecular friction resulting from the high frequency electromagnetic radiation cooks the food adequately, it does not brown the cooked food. This negatively affects the taste, visual appeal, and general gastronomic appeal of the food. It is highly desirable when cooking food with microwave energy to brown the exterior of the food so the food resembles food cooked by conventional methods. (Throughout this specification, the term "brown" includes browning, crisping, searing, and otherwise heating the exterior surface of food.) Therefore, special provision must be made to brown the exterior of the food and to avoid undercooking the exterior of the food due to the surface cooling effect on the food. Many products, devices, and methods have been devised in the prior art for browning, searing, and otherwise heating the exterior surface of food cooked in microwave ovens.

An increasingly common method for browning food has been to incorporate microwave interactive layers into disposable laminate materials used to cook the food. Such laminates are characterized by their ability to absorb microwave energy and convert it to heat which may be conductively and radiantly transmitted to the food. Semiconductive materials, ferro-magnetic metals, metal oxides, and thin elemental metals are some of the materials used to form the microwave interactive layer. U.S. Pat. No. 4,230,924 to Brastad et al. and U.S. Pat. No. 4,267,420 to Brastad disclose using a flexible wrapping material for browning food in a microwave oven including a thin aluminum layer sandwiched between a layer of polyester and a layer of polyethylene. Laminates of the type disclosed in the '924 and '420 patents suffer numerous drawbacks: the sheet laminate may not be sufficiently flexible to contact the exterior surface of the food without extending away from the food at some portions; where the exterior surface of the food is irregular parts of the laminate do not contact the food and the food is not adequately browned; and portions of the laminate may actually melt, shrivel, burn, or otherwise disintegrate when subject to microwave energy. Additionally, these patents do not disclose a scheme for forming receptacles or packages out of a long web suitable for use in modern, high speed package forming equipment.

Many of the problems noted with respect to the flexible wrapping material of the '420 and '924 patents were overcome by U.S. Pat. No. 4,641,005 to Seiferth. Seiferth discloses the concept of bonding a thin continuous layer of interactive metal formed on the smooth surface of a heat stable thin layer of plastic such as polyester directly to a dimensionally stabilizing layer of microwave transparent stock material such as paper. The dimensionally stabilizing layer imparts a number of additional advantages not the least of which is to serve as the integral part of a package suitable for shipping, displaying, cooking, and serving food. In addition, the process of bonding the interactive metal-coated side of the plastic layer is also believed to impart a limiting temperature characteristic to the dimensionally stabilized laminate. This provides rigidity and support to the metallized plastic layer and thus prevents contortion and irregular heating. The resulting laminate is formed with sufficient flexibility to permit the laminate to be "wrapped" around a substantial portion of the contour of a food item to be cooked.

Despite the breakthrough provided by the '005 patent, or perhaps because of it, numerous concerns relating to the formation of disposable food packages for microwave cooking have arisen. These concerns relate to the formation of the food container in such a way as to provide a low cost yet effective mechanism through which a disposable microwave cooking container may be manufactured and the food articles may be encased in the container. In particular, experience with microwave interactive laminates has shown that, under certain circumstances, food may be lost during the packaging process unless it can be encased rapidly and efficiently in an automated process. Another problem has been to provide graphics, sealing material and the microwave interactive layer so that each of these important parts of a food package are in proper registry with each other. Still another concern is to facilitate handling the package in and out of a microwave oven. Finally, formation of the package so the microwave interactive layer does not damage the seal during cooking in a microwave oven can be a vexing problem in certain circumstances.

U.S. Pat. No. 4,034,973 to Hams discloses an automated in-line mailing system in which a continuous web of paper is supplied, cut, folded, collected, and inserted into envelopes. This process is performed automatically and is controlled by a column of marked indicia on the paper web. While this patent is believed to be representative of automated systems controlled by indicia, the Hams system is not directed to food packaging. It does not even hint at the problems which plague the mass production of food containers for heating and browning food in a microwave oven.

Although U.S. Pat. No. 4,735,513 to Watkins et al. discloses forming a microwave receptacle from a long web of material, it too does not address the above problems. Performing various functions such as printing graphics, applying sealant, and applying microwave interactive material in registry on the web are not disclosed.

No one has disclosed a packaging material or a method of forming a packaging material that addresses and solves all of the discussed problems.

SUMMARY OF THE INVENTION

It is an object of the present invention to provide a flexible, disposable food container for microwave cooking that overcomes the deficiencies of the prior art by providing an effective, low cost packaging material suitable for use in a mechanized package process to create a flexible container for shipping, storing, and microwave heating food.

It is another object to provide a process for forming a flexible, disposable packaging material for forming a food container for microwave cooking that browns and adequately heats the exterior of the food and overcomes the deficiencies of the prior art.

The inventor has discovered that one of the most debilitating problems associated with flexible food containers for microwave cooking has been the need to adequately form a flexible container having graphics, sealant material, and a microwave interactive layer formed at appropriate locations on the container in registry with each other. This is particularly difficult because each item must be disposed on a different substrate. The sealant material must be disposed on the inside of the container material on the plastic layer; the printed graphics must be disposed on the outside of the container material on the structural stock material layer; and the microwave interactive material normally needs to be disposed between the plastic and structural stock material layers.

The printed graphics need be in precise registry to provide a visually appealing package by properly centering the graphics without printing the graphics in hard-to-read portions of the container and without relying on a repeated, random pattern of graphics which is unattractive. The microwave interactive layer must be precisely located to maximize contact with the food articles to best heat and brown the food.

The sealant material must be carefully located and disposed on the container material so that it will not be damaged by the heat of the microwave interactive layer during cooking. If the sealant material and the microwave interactive material are too close to each other or contact each other, the heat created by the microwave interactive layer could destroy the sealing properties of the sealant material; the package could then open and spill the contents in the oven. Additionally, if the sealant material breaks down, portions may enter the food and be ingested.

It is, therefore, an object of the present invention to provide a packaging material in which a microwave interactive material is sandwiched between a plastic layer and a structural stock material layer, graphics are provided on the structural stock material layer, and sealant is provided on the plastic layer for forming a package. The microwave interactive layer, the graphics, and the sealant are provided at appropriate locations on the packaging material and are provided in registry with each other to overcome the problems discussed above. It is also an object of the present invention to provide a method for manufacturing a web of packaging material having the microwave interactive layer, the graphics, and the sealant in registry.

One production problem frequently encountered with packaging food is the loss of portions of the food, such as french fries, or the loss of part of the food, such as pizza toppings, during the preparation and packaging process before the food is actually packaged. For example, pizza is spiraled through a freezer before being placed in its container. During freezing, toppings fall off of the pizza resulting in lost product and lost money. Although it is known to place a shrink wrap around the pizza before freezing, the shrink wrap must be removed before cooking the pizza. If not removed, the shrink wrap will break down and ruin the pizza.

Another problem encountered with flexible food packages is the difficulty of opening the package. Many packages require cutting with a scissors, which destroys the package. Perforations on the package aid this process, but do not otherwise address the problem of creating an easily openable package that is usable for cooking, handling, and serving after the package has been opened. This problem is closely related to the package handling problem. In order to best cook food in a microwave oven, the food should not be in a sealed container. The container should be opened to allow venting. However, after opening the container, it is difficult to handle the food without spilling the food from the opened container or without placing the food container on a separate tray. This alternative further detracts from the cooking of the food by impairing the path of the microwave energy. This problem is compounded because the cooked food is hot. If, in carrying the cooked food from the microwave oven to the table, some of the food should contact the server, the server could be burnt, and the cooked food likely dropped. What is needed are handles to facilitate handling of an opened, full, flexible food container that minimizes potential injury and food loss.

It is another object of the present invention to provide a process which curtails the loss of food during the packaging process.

It is another object to provide a package using sealant material and a sealing method to create a fin seal which accommodates the other objects and which allows the package to be conveniently sealed during the formation process while being simple to open by the consumer.

It is another object to provide a package which achieves the above objects and which includes graphics, sealant material, and a microwave interactive layer in registry on the sheet of material which forms the food container.

It is another object to provide a package which achieves the above objects and which is easy to handle in and out of the microwave oven while also facilitating serving food.

It is another object to provide a flexible disposable food container that can contain and maintain a quantity of food in a fresh and sanitary condition, that can be used to ship the container of food from a factory to a warehouse to a store to a home, that can display the food to the consumer in the store in a presentable fashion, that can heat and brown the food contained within the container when exposed to microwave energy in a microwave oven, and that can serve the cooked food to the consumer after removal from the microwave oven.

It is another object to provide a flexible disposable food container that can be formed from webs of material where the material webs are sufficiently flexible to be wound, unwound and transferred as either cut sheets or a continuous web.

It is another object to accomplish the above and other objects in a simple, economical, and relatively inexpensive manner.

These and other objects are attained by the packaging material and the method of forming a flexible disposable food container from the packaging material according to the present invention. The container is adapted to contain and maintain a quantity of food in a fresh and sanitary condition, and to ship the food from a factory to a warehouse to a store to a home. The container also displays the food to the consumer in the store in a presentable fashion, and heats and browns the food when exposed to microwave energy in a microwave oven. The container serves the food to the consumer after removal from the microwave oven.

The web of packaging material includes a susceptor of microwave interactive material formed on a layer of plastic. A layer of structural stock material is laminated to the metallized plastic layer. Graphics are applied to the outside of the structural stock material and sealant is applied to locations around the edges of the plastic layer.

The method of forming the packaging material web includes forming patches of microwave interactive material on a web of plastic such as polyester. The microwave interactive material can be an elemental metal or a metal oxide and may be formed by printing the metal on the plastic or applying a metal patch to the plastic. Alternatively, the plastic may be formed with a metallized layer on one surface and portions of metal are either mechanically removed or chemically focused to remove its microwave interactive capability from the requisite portions. The web of plastic is laminated to one side of a web of structural stock material to form a composite web. The structural stock material is preferably kraft paper having low density, high insulating capacity, and high heat stability. The composite web has a plastic layer and a structural stock material layer so that the microwave interactive material is sandwiched between the web of plastic and the web of structural stock material. Sealant is applied to portions of the plastic layer in registry with the patches of microwave interactive material to seal ends of the composite web. The sealant is located to form the container and prevent the heat of the microwave interactive material from disrupting the seal during cooking in the microwave oven. The sealant may be a hot melt material or a pressure sensitive cold seal. Printed graphics are applied to portions of the structural stock material layer in registry with the patches of microwave interactive material and the sealant. This provides a visually appealing package by properly centering the graphics without impairing the effectiveness of the microwave interactive material, without applying the graphics in difficult-to-read portions of the package, and without using a repeated, random pattern. The composite web is next rewound onto a roll preparatory to forming the composite web into a container.

The composite web of packaging material can now be formed into a container shape and the appropriate ends of the composite web are sealed. Next, the food is inserted into the container, the container is sealed around the food, and the container is cut off from the composite web.

The formed container is sufficiently flexible to contain food having curved and irregular surfaces and to maximize contact of the food with the portion of the container housing the microwave interactive material. The container is sealed so that portions of the composite web extend as fins beyond the sealed ends of the food-containing portion of the container. This enables the container to be opened without destroying the container, allows the container to be used for cooking and to permit browning while inhibiting steaming of the food, and enables the fins to be used as handles for the opened container. The container also is capable of receiving food before the food is frozen to prevent portions or parts of the food from falling out of their proper place in the food packaging process.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
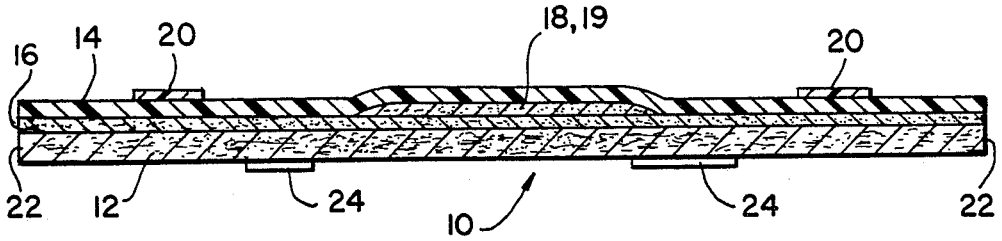
FIG. 1 is a cross-sectional view of a composite sheet of material which forms the flexible disposable food container for microwave cooking before being formed into the-container.
Figure 2:
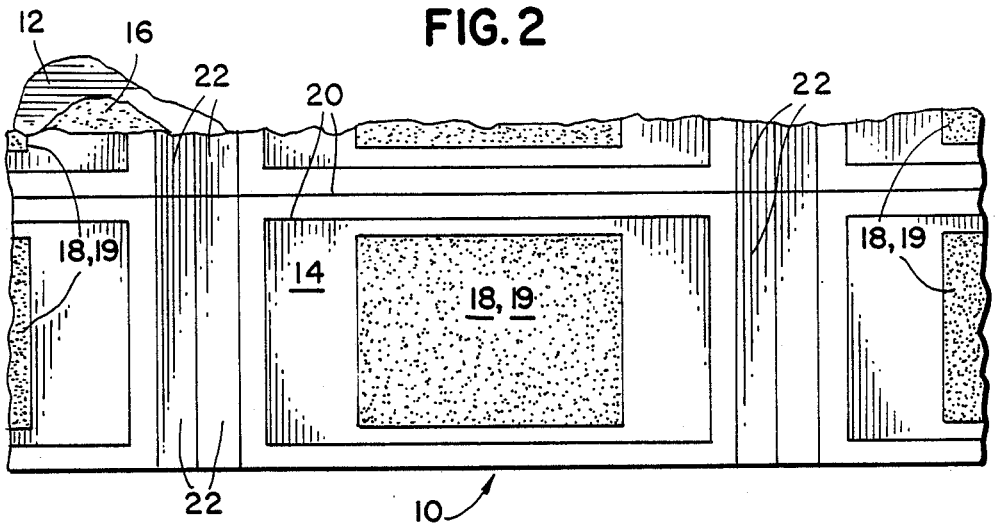
FIG. 2 is a top view of the composite sheet of material of FIG. 1.

Referring first to FIG. 1, composite sheet of material 10 to be formed into a flexible disposable food container for microwave cooking is shown. Composite sheet 10 includes a layer of structural stock material 12. Preferably, structural stock material 12 is low density, high insulating capacity, high heat stability paper or coated paper such as 40 lb. kraft paper. Alternately, structural stock material 10 may be formed from glassine materials, plastics, or ceramics. A layer of plastic 14, such as polyester or polyethylene teraphthalate (PET) is laminated to paper sheet 12 via adhesive 16. Alternately, layer 14 may be formed of paper. In the central portion of composite sheet 10, microwave interactive layer 18 is formed on plastic layer 14 and is sandwiched between plastic layer 14 and paper layer 12. Microwave interactive layer or metallized layer 18 is preferably formed of an elemental metal such as aluminum or a metal oxide. Sealant material 20, which may be hot melt material or cohesive cold seal material is disposed around the border of plastic layer 14 as best shown in FIG. 2. As shown, sealant 20 does not extend to the edges of plastic layer 14 on two sides. Fins 22 extend between the outer edge of sealant 20. Graphics 24 are printed on portions of paper layer 12 as shown. Using the system of the present invention, graphics 24 need not be a repeating, random pattern. Rather, the graphics can be an aesthetically pleasing, carefully located display. FIG. 2 further illustrates that composite sheet 10 may be formed from rolled webs of material that are a plurality of container widths wide.

Figure 3:
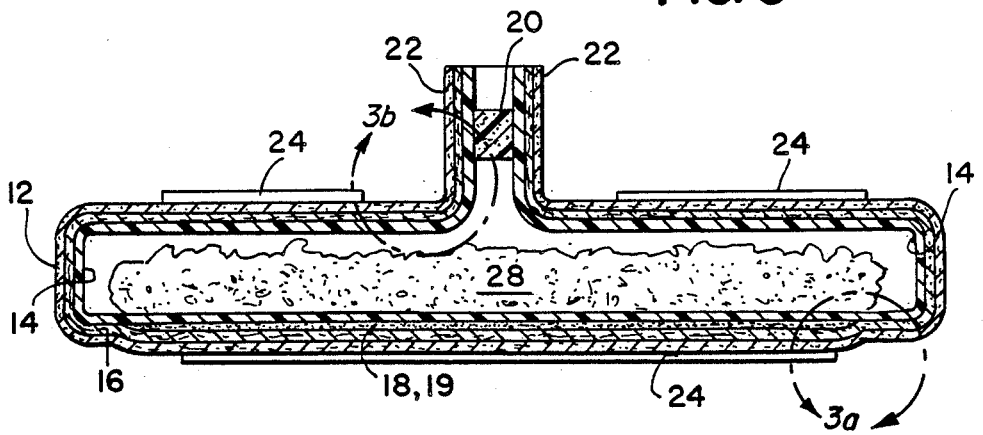
FIG. 3 is a cross-sectional view of the composite sheet of material of FIG. 1 after being formed into a food container.
Figure 3B:
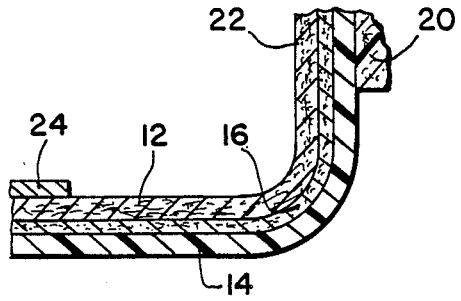
FIGS. 3*a* and 3*b* are enlarged views of portions of FIG. 3.
Figure 3A:
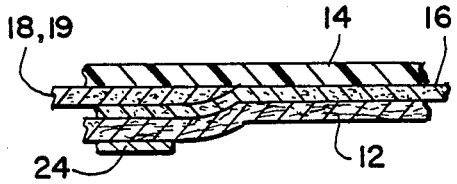
Figure 4:
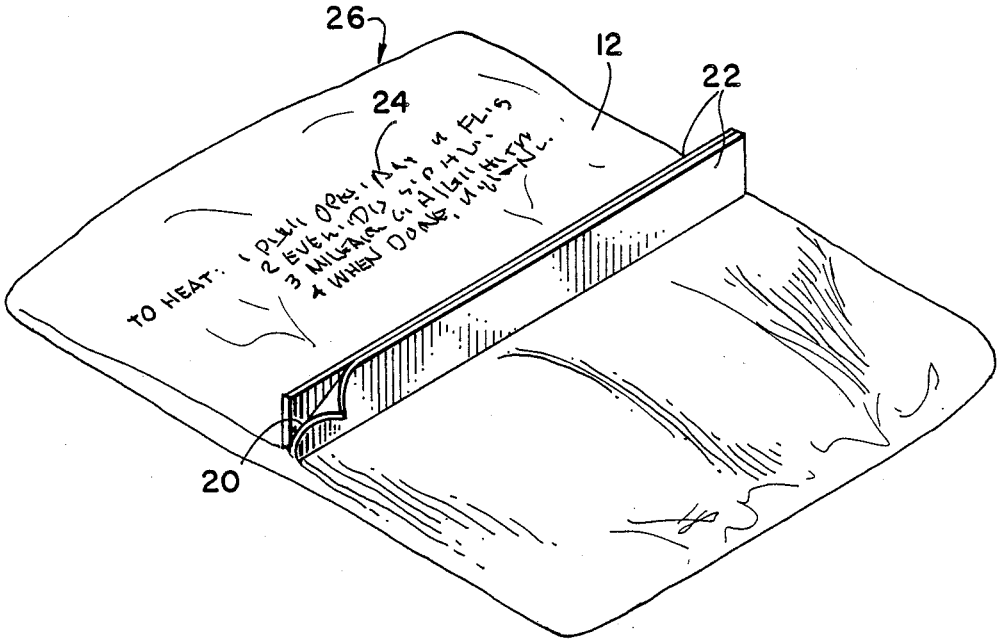
FIG. 4 is a perspective view of the food container of FIG. 3.

FIGS. 3 and 4 illustrate composite sheet 10 formed into container 26. As shown in FIG. 3, container 26 contains pizza 28, and in FIG. 4 container 26 houses french fried potatoes. FIG. 3 illustrates that graphics 24 may be formed on the bottom surface of container 26 as well as both top half surfaces. FIGS. 3*a* and 3*b* are enlarged portions of composite web 10 further exaggerating the size of the various elements for clarity.

Figure 5:
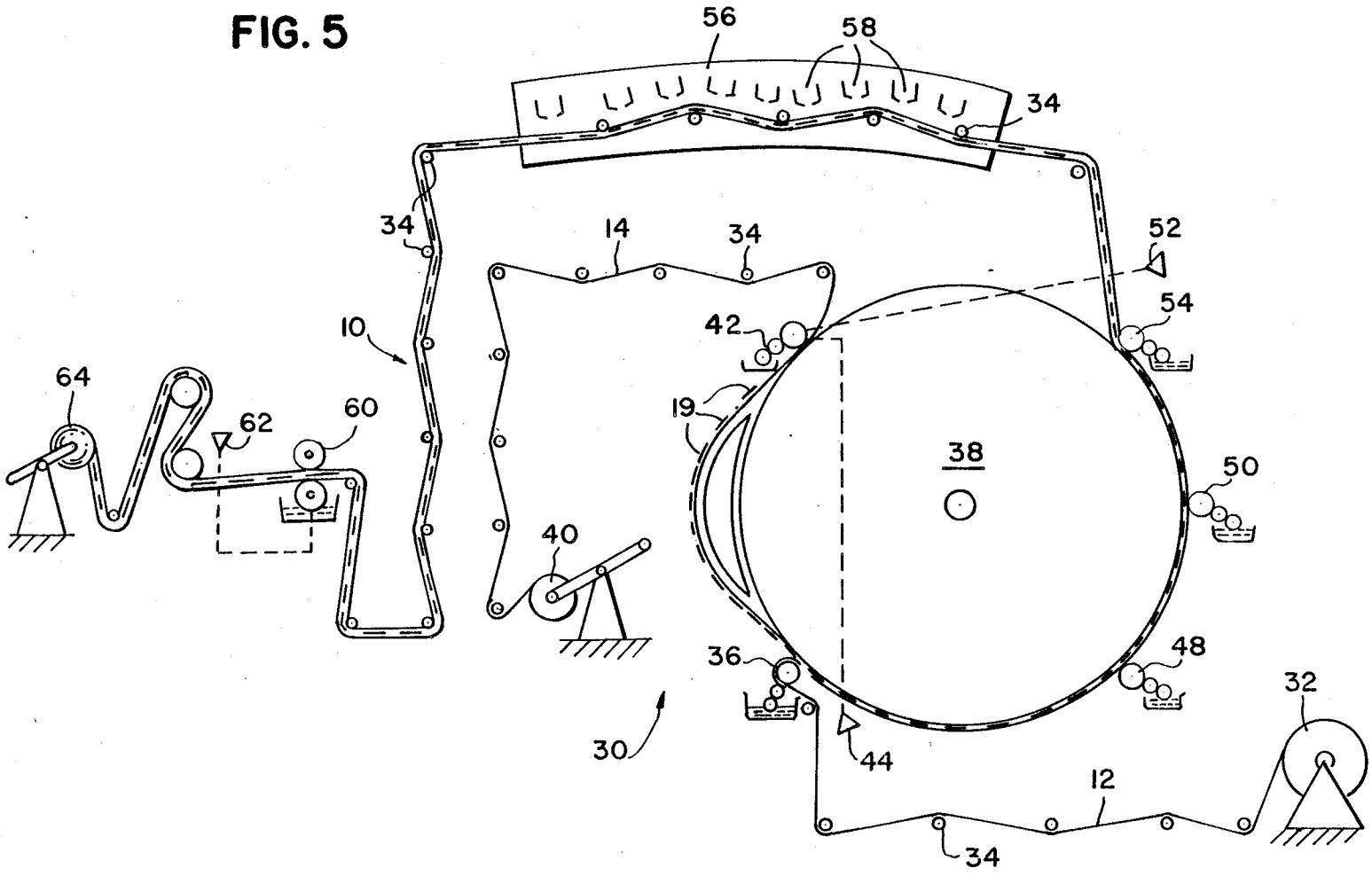
FIG. 5 is a schematic diagram showing one apparatus for performing the method of making the flexible disposable food container for microwave cooking according to the present invention.

FIG. 5 illustrates the system for performing the method of forming flexible disposable food containers for microwave cooking according to the present invention. System 30 mass produces these food containers and includes paper roll 32 of paper web 12. Paper web 12 is unwound from paper roll 32 and is drawn across rollers 34 to laminating station 36 which applies adhesive 16 to paper 12. Laminating station 36 is disposed adjacent central impression drum 38. Concurrently, plastic web 14 is unwound from plastic roll 40. Plastic web 14 is drawn around rollers 34 until it reaches microwave interactive layer forming station 42 adjacent central impression drum 38. Microwave interactive layer forming station 42 causes a patch or susceptor 19 of metallized material 18 to be formed at discrete locations along plastic web 14.

Where plastic web 14 on plastic roll 40 does not have a metallized layer preformed thereon, station 42 places metallized layer 18 on portions of plastic web 14 corresponding to the required position of metallized layer 18 in the completed container 26 after container 26 has been formed from composite web 10. Disposing portions of metallized layer 18 on plastic web 14 can be accomplished by applying a patch of metallized layer 18 at the discrete locations on plastic web 14. This operation is relatively slow. Alternatively, metallized layer 18 may be printed on plastic web 14 at station 42. Where plastic web 14 on plastic roll 40 is preformed with metallized layer 18, microwave interactive layer forming station 42 limits the effectiveness of metallized layer 18 to the required discrete portions. This may be accomplished mechanically by abrading and removing portions of the metallized layer according to the abrasion process disclosed in U.S. patent application Ser. No. 143,483, assigned to James River Corporation, the assignee of this application. Preferrably, the metallized layer may be treated to reduce or eliminate its microwave interactive capability according to the chemical deactivation method known as focusing disclosed in U.S. patent application Ser. No. 024,063, assigned to James River Corporation, the assignee of this application. The disclosures of these applications are incorporated herein by reference. Although any type of mechanical demetallization or chemical deactivation method may be used, it is preferable to chemically focus the metallized layer using sodium hydroxide.

Focusing station 42 is actuated to form susceptors 19 at the proper discrete locations on plastic web 14 by a microelectronic feedback system which includes mark reader 44 which detects and reads eye marks preprinted on plastic web 14. Marks are preprinted at spaced locations such as every container length or every second container length and indicate the dimensions for a container. Mark reader 44 senses a mark and directs focusing station 42 to form susceptor 19 on plastic web 14. Mark reader 44 serves to register susceptors 19 with preprinted graphics when paper web 12 is preprinted with graphics. After plastic web 14 has been focused and has portions of metallized layer 18 disposed thereon at discrete locations, plastic web 14 passes over heater 46 disposed adjacent central impression drum 38. Heater 46 promotes the sodium hydroxide reaction. (Where susceptor 19 is printed on or applied as a patch, heater 46 serves to dry susceptor 19.)

Next, the multi-layered web including plastic layer 14 and metallized layer 18 in the form of susceptors 19 is moved around central impression drum 38 to laminating station 36, where it meets paper layer 12. Laminating station 36 combines the three layers into composite web 10. From this point until composite web 10 leaves lacquer print station 54, discussed below, composite web 10 remains precisely against the outer surface of central impression drum 38 to automatically register the web with stations 48, 50, and 54. Central impression drum 38 maintains web 10 thereon without slipping or movement, thereby acting as a self-registration drum.

From laminating station 36 composite web 10 moves around central impression drum 38 until it reaches first and second print stations 48, 50. First printing station 48 applies graphics 24 of one color and second printing station 50 applies graphics 24 of another color in registry with printing station 48. Printing stations 48, 50 are actuated by mark reader 52 of the microelectronic feedback system. As web 10 does not leave central impression drum 38, printing stations 48, 50 need not be externally registered. Where printing is performed at printing stations 48, 50, mark reader 52 causes printed graphics 24 to be applied to composite web 10 by first and second printing stations 48, 50 in registry with the location of susceptor 19. Mark reader 52 registers web 10 with interactive layer forming station 42 because, after web 10 passes station 42 it leaves central impression drum 38, thereby providing a potential opportunity for web 10 to shift out of registry for further operations. Alternatively, where a large number of colors are to be applied as part of graphics 24 on container 26, paper web 12 may have graphics 24 applied thereon before paper web 12 is placed on paper roll 32. In this instance, mark reader 44 operates to register susceptors 19 on plastic layer 14 with the locations of graphics 24 on paper web 12. Mark readers 44 and 52 are not operated simultaneously. In either instance, graphics 24 are applied on the paper side of composite web 10 at precise locations on composite web 10 so container 26 will have graphics 24 disposed at the proper locations. Graphics 24 will not reside in difficult-to-read locations. Nor is a repeated, random, wallpaper-type pattern required.

At this point, composite web 10 moves further around central impression drum 38 to lacquer print station 54 disposed adjacent central impression drum 38. At lacquer print station 54, lacquer is applied to the printed surface of paper layer 12. This provides a finished look to the printed graphic surface. The lacquer printing step is the final preparation stage that occurs at the central impression drum. Alternatively, where multicolored graphics are preprinted on paper web 12, the lacquering step may be performed before the metallized plastic layer is laminated to the paper web.

Composite web 10 now passes around rollers 34 and enters dryer 56 which is an elongate enclosed section having a plurality of hot air jets 58 disposed along its length. Dryer 56 has a smooth curvature, as shown, to prevent web 10 from fluttering. Composite web 10 is disposed over rollers 34 within dryer 56. Hot air jets 58 blow air perpendicular to web 10. Hot air jets 58 blow dry composite web 10, drying the ink, removing water to prevent blistering, and otherwise placing composite web 10 in condition for the application of sealant material 20. After composite web 10 leaves dryer 56, it passes around rollers 34 until it arrives at sealant application station 60.

At sealant application station 60, sealant material 20 is applied to the plastic side of composite web 10. Sealant material 20 is applied to the required portions of composite web 10, as shown in FIG. 2. Sealant material 20 may be hot melt sealant material or it may be cohesive, self-sealing, pressure sensitive cold seal material. The form of seal varies with the specific application. When hot melt adhesive is used, the container may be sealed immediately. Preferrably, the sealant is allowed to cool and congeal, and it is later reheated and sealed. It has been found that when food is disposed in container 26 after being transported to container 26 along a horizontal conveying device, a cold seal is usually preferred. Where food is dropped vertically into container 26 a hot melt heat seal is usually preferred. Regardless of what type of seal is used, the operation of sealant application station 60 is governed by mark reader 62 of the microelectronic feedback system. Mark reader 62 reads marks on composite web 10 and directs sealant application station 60 to apply sealant material 20. Thus, sealant material 20 is applied to the plastic side of composite web 10 in registry with the locations of susceptor 19 and graphics 24. This permits sealant material 20 to be located at predetermined distances from susceptor 19 to keep sealant material 20 free from the effects of the heat created by susceptor 19 when container 26 is subjected to microwave energy in a microwave oven. This prevents sealant material from melting, breaking down, shrinking, burning, shriveling, or disintegrating, drawbacks prevalent with many prior mass produced containers. Additionally, sealant material 20 is disposed on composite web 10 so that when container 26 is formed, fins 22 extend from the sealed portions of container 26. Fins 22 serve as gripping handles for opening container 26 as well as carrying handles for carrying opened container 26. In a secondary embodiment, instead of using fins for opening and carrying container 26, perforations may be formed along the fin seal for opening.

After sealant material 20 is applied, composite web 10 proceeds around rollers 34 to rewind roll 64. Composite web 10, completely formed of successive layers of lacquer, graphics 24, paper 12, metallized layer 18, adhesive 16, plastic 14, and sealant material 20, is rewound around rewind roll 64. After composite web 10 is completely rewound, it is removed from rewind roll 64 preparatory to being formed into containers 26. Any finishing operations such as edge trimming are performed now. Composite web 10, paper web 12, and plastic web 14 have been described as being one container width wide. However, as shown in FIG. 2, these components may be two or more container widths wide. Where the webs are more than one container width wide, metallized layer 18 is formed so that the required number of susceptors 19 are formed and located on plastic web 12. Other than cutting the formed composite web 10 either before or after it is rewound onto rewind roll 64, the process for forming containers 26 remains the same.

The roll of composite web 10 is next brought to a container-forming machine which forms the roll of composite web 10 into a plurality of containers 26, and fills containers 26 with food before sealing containers 26. Generally, the container-forming machine forms containers 26 via the following steps. First, the end of the roll of composite web 10 is unrolled. Formers are placed at locations at the end of the roll to form the flat sheet into a generally tube-like shape. The fin seal, which is the seal forming the containeropening seam, is then formed. Next, the bottom end seal is formed and the food is disposed within the container. The top of the container is then sealed and the container is cut off of the roll.

Container 26 is designed and the food is disposed within container 26 so that the food covers an area substantially equal to the area of susceptor 26. An amount of food is placed in container 26 so that where the food includes a plurality of items such as french fries, the food is disposed substantially only one level high. That is, container 26 is packed with food so that when the food settles and container 26 lies on its side having susceptor 19, preferrably no item of food nests on another item. All of the food items nest on the bottom of container 26 on susceptor 19. This maximizes food contact with susceptor 19, thereby maximizing the heating area of susceptor 19 per unit of food per unit cost. Because container 26 is formed of flexible layers that are much more flexible than paperboard, container 26 may be used to contain foods having curved and irregular surfaces while still maximizing contact between the food and susceptor 19.

The method of forming packaging material for flexible, disposable food containers for heating and browning the contained food in a microwave oven addresses and solves the problems discussed above that have hindered microwavable food containers. The method forms a flexible disposable container having graphics, sealant material, and a microwave interactive layer formed at proper locations in registry with each other on the composite layer that forms the container. This is accomplished using the central impression drum having a plurality of stations as discussed above. Marks disposed on the plastic web and the structural stock material web are read so that the microwave interactive layer and the printed graphics are applied at their appropriate locations while the webs are located adjacent the central impression drum. The sealant material is applied when the appropriate marks are read at a location downstream of the central impression drum. These applications are performed accurately on their respective web substrates. The graphics are printed in their proper position; random, repeated graphics are not required. The microwave interactive material is located to maximize contact with the food articles being cooked to best heat and brown the food. The sealant material is located to be free from breakdown due to the heat of the microwave interactive layer.

The method produces a flexible package having a fin seal. The fins on which the sealant material is applied to seal the food within the container are formed of excess web material beyond the location of the sealant material. This provides handles by which the package can be opened. Pulling the two fins apart breaks the seal and opens the container without destroying the container. This enables the container to be used for cooking. The fins also serve as handles with which to carry the opened container from the microwave oven to the table.

The method and the food containers produced thereby also can be used to solve the problem of lost food during the packaging process. The containers may receive food articles before the food is frozen. This prevents food from falling off of the assembly line during the freezing process. Thus, the food can be safely contained before freezing in the factory, and the container can also be used to cook the food in a microwave oven. The container's utility extends for virtually the entire life of the food. The container receives the food just after the food is prepared and before it is frozen. The container is used to protect the food as it is frozen, store the food in a warehouse, ship the food from the factory to the warehouse to a store to the home, display the food to the consumer in the store in a presentable fashion, heat and brown the food in a microwave oven, serve the food after removal from the oven, and maintain the food fresh and sanitary throughout all of the above functions.

Industrial Applicability

The present invention finds application in the mass production of food containers for microwave cooking. The method is particularly useful with containers used for browning the food while heating and forms containers that are attractive graphically and that can properly cook foods in a microwave oven.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A packaging material for forming a flexible, disposable food container adapted to contain and maintain food in a fresh and sanitary condition, to ship the food from a factory to a warehouse to a store to a home, to display the food to the consumer in the store in a presentable fashion, to heat and brown the food when exposed to microwave energy in a microwave oven, and to serve the food to the consumer after removal from the microwave oven, the packaging material comprising:

a first layer of material;

a layer of microwave interactive material formed as patches on the first layer of material;

a layer of structural stock material laminated to the first layer of material so as to sandwich the patches of microwave interactive material between the first layer of material and the layer of structural stock material; and sealant disposed on portions of the first layer of material in registry with the patches of microwave interactive material, the sealant being located to seal ends of the packaging material to form the container and to prevent the heat of the microwave interactive material from disrupting the seal during cooking in the microwave oven.

2. A packaging material according to claim 1 wherein the first layer of material comprises paper.

3. A packaging material according to claim 1 wherein the first layer of material comprises plastic.

4. A packaging material according to claim 3 further comprising printed graphics applied to portions of the structural stock material layer in registry with the patches of microwave interactive material and the sealant to provide a visually appealing package by properly centering the graphics without impairing the effectiveness of the microwave interactive material, without applying the graphics in difficult-to-read portions of the package, and without using a repeated, random pattern.

5. A packaging material according to claim 3 wherein the packaging material is sufficiently flexible to form a container to contain food having curved and irregular surfaces and to maximize contact of the food with the portion of the container housing the microwave interactive material.

6. A packaging material according to claim 3 wherein the packaging material can form a container that is sealable so that portions of the packaging material extend as fins beyond the sealed ends of the food-containing portion of the container to enable the container to be opened without destroying the container, to allow the container to be used for cooking and to permit browning and venting while inhibiting steaming of the food, and wherein the fins are usable as handles for the opened container.

7. A packaging material according to claim 3 wherein the packaging material can form a container that is capable of receiving food before the food is frozen to prevent portions or parts of the food from falling out of their proper place in the food packaging process.

8. A packaging material according to claim 3 wherein the layer of plastic comprises polyester.

9. A packaging material according to claim 3 wherein the microwave interactive material comprises metal.

10. A packaging material according to claim 3 wherein the web of structural stock material comprises paper having low density, high insulating capacity, and high heat stability.

11. A packaging material according to claim 3 wherein the sealant comprises a hot melt material.

12. A packaging material according to claim 3 wherein the sealant comprises a cohesive, pressure sensitive cold seal.

13. A method of forming a flexible, disposable food container adapted to contain and maintain food in a fresh and sanitary condition, to ship the food from a factory to a warehouse to a store to a home, to display the food to the consumer in the store in a presentable fashion, to heat and brown the food when exposed to microwave energy in a microwave oven, and to serve the food to the consumer after removal from the microwave oven, the method of forming the flexible, disposable food container comprising the steps of:

forming patches of microwave interactive material on a web of material;

laminating the web of material to one side of a web of structural stock material to form a composite web having a material layer and a structural stock material layer so that the microwave interactive material is sandwiched between the web of material and the web of structural stock material;

applying sealant to portions of the material layer in registry with the patches of microwave interactive material to seal ends of the composite web to form the container and to prevent the heat of the microwave interactive material from disrupting the seal during cooking in the microwave oven; and rewinding the composite web onto a roll preparatory to forming the composite web into a container and inserting food therein.

14. A method according to claim 13 wherein said web of material comprises plastic.

15. A method according to claim 14 further comprising printed graphics applied to portions of the structural stock material layer in registry with the patches of microwave interactive material and the sealant to provide a visually appealing package by properly centering the graphics without impairing the effectiveness of the microwave interactive material, without applying the graphics in difficult-to-read portions of the package, and without using a repeated, random pattern.

16. A method according to claim 14 further comprising the steps of:

forming the end of the composite web into a container shape and sealing appropriate ends of the container to maintain the container shape;

inserting food into the container;

sealing the container around the food; and cutting the container off of the composite web.

17. A method according to claim 14 wherein the container is sufficiently flexible to contain food having curved and irregular surfaces and to maximize contact of the food with the portion of the container housing the microwave interactive material.

18. A method according to claim 14 wherein the container is sealed so that portions of the composite web extend as fins beyond the sealed ends of the food-containing portion of the container to enable the container to be opened without destroying the container, to allow the container to be used for cooking and to permit browning and venting while inhibiting steaming of the food, and wherein the fins are usable as handles for the opened container.

19. A method according to claim 16 wherein the container also is capable of receiving food before the food is frozen to prevent portions or parts of the food from falling out of their proper place in the food packaging process.

20. A method of forming a flexible, disposable food container adapted to contain and maintain food in a fresh and sanitary condition, to ship the food from a factory to a warehouse to a store to a home, to display the food to the consumer in the store in a presentable fashion, to heat and brown the food when exposed to microwave energy in a microwave oven and to serve the food to the consumer after removal from the microwave oven, the method of forming the flexible, disposable food container comprising the steps of:

forming patches of microwave interactive material on a web of plastic;

laminating the web of plastic to one side of a web of structural stock material to form a composite web having a plastic layer and a structural stock material layer so that the microwave interactive material is sandwiched between the web of plastic and the web of structural stock material;

applying sealant to portions of the plastic layer in registry with the patches of microwave interactive material to seal ends of the composite web to form the container and to prevent the heat of the microwave interactive material from disrupting the seal during cooking in the microwave oven;

applying printed graphics to portions of the structural stock material layer in registry with the patches of microwave interactive material and the sealant to provide a visually appealing package by properly centering the graphics without impairing the effectiveness of the microwave interactive material, without applying the graphics in difficult-to-read portions of the package, and without using a repeated, random pattern;

rewinding the composite web onto a roll preparatory to forming the composite web into a container;

forming the composite web into a container shape and sealing appropriate ends of the container to maintain the container shape;

inserting the food into the container;

sealing the container around the food; and cutting off the container from the composite web;

wherein the container is sufficiently flexible to contain food having curved and irregular surfaces and to maximize contact of the food with the portion of the container housing the microwave interactive material;

wherein the container is sealed so that portions of the composite web extend as finds beyond the sealed ends of the food-containing portion of the container to enable the container to be opened without destroying the container, to allow the container to be used for cooking and to permit browning while inhibiting steaming of the food, and wherein the fins are usable as handles for the opened container; and wherein the container is capable of receiving food before the food is frozen to prevent portions or parts of the food from falling out of their proper place in the food packaging process.

21. A method according to claim 20 wherein the web of plastic comprises polyester.

22. A method according to claim 20 wherein the patches of microwave interactive material are formed on the web of plastic by chemically focusing to eliminate the microwave interactive capability of portions of metal on a metallized plastic web so that patches of operational microwave interactive material remain in the required locations.

23. A method according to claim 20 wherein the step of forming patches of microwave interactive material on a web of plastic comprises mechanically removing portions of microwave interactive material from a metallized web of plastic so that patches of microwave interactive material remain in the required locations.

24. A method according to claim 20 wherein the step of forming patches of microwave interactive material on a web of plastic comprises printing a layer of microwave interactive material in the required locations of the web of plastic.

25. A method according to claim 20 wherein the step of forming patches of microwave interactive material on a web of plastic comprises applying patches of microwave interactive material on a web of plastic in the required locations.

26. A method according to claim 20 wherein the microwave interactive material comprises metal.

27. A method according to claim 20 wherein the web of structural stock material comprises paper having low density, high insulating capacity, and high heat stability.

28. A method according to claim 20 wherein the sealant comprises a hot melt material.

29. A method according to claim 20 wherein the sealant comprises a cohesive, pressure sensitive cold seal.

30. A method according to claim 20 further comprising the step of lacquering the web of structural stock material.

31. A method according to claim 22 wherein the chemical focusing is performed using sodium hydroxide and wherein the method further comprises the step of heating the web of plastic after the patches of microwave interactive material have been formed to promote the sodium hydroxide reaction.

32. A method according to claim 20 wherein the web of structural stock material and the web of plastic both have widths equal to a multiple of widths of the finished food container and wherein the method further comprises the step of cutting the composite web in a lengthwise direction to form a plurality of composite webs each having a width equal to the width of a food container.

33. A method according to claim 20 wherein the food is brought to the food container in a horizontal direction and the food container is sealed around the food using a cold seal.

34. A method according to claim 20 wherein the food is dropped vertically onto the package and the package is folded around the food using a hot melt seal.

35. A method according to claim 20 wherein a plurality of food articles are disposed in each container and wherein the food articles disposed in each container are arranged so that the food articles are only one level of food high within the container to maximize contact between the food articles and the microwave interactive layer.

36. A method according to claim 35 wherein the container provides a large area of microwave interactive material per unit of food per unit cost.

37. A method according to claim 20 wherein the forming patches and laminating steps are performed on a central impression drum so that registration of one step on the web of plastic places the forming patches, laminating, sealant applying, and graphics applying steps in registry.

38. A method according to claim 37 wherein the step of applying printed graphics is performed on the central impression drum.

39. A flexible, disposable food container adapted to contain and maintain food in a fresh and sanitary condition, to ship the food from a factory to a warehouse to a store to a home, to display the food to the consumer in the store in a presentable fashion, to heat and brown the food when exposed to microwave energy in a microwave oven, and to serve the food to the consumer after removal from the microwave oven, the flexible, disposable food container being formed by the method of claim 11.

40. A flexible, disposable food container adapted to contain and maintain food in a fresh and sanitary condition, to ship the food from a factory to a warehouse to a store to a home, to display the food to the consumer in the store in a presentable fashion, to heat and brown the food when exposed to microwave energy in a microwave oven, and to serve the food to the consumer after removal from the microwave oven, the flexible, disposable food container being formed by the method of claim 17.

* * * * *